US005564578A

United States Patent [19]

Smith

[11] Patent Number: 5,564,578

[45] Date of Patent: Oct. 15, 1996

[54] MULTIFACETED DISPLAY STAND

[75] Inventor: Michael J. Smith, Orangeburg, N.Y.

[73] Assignee: Arrow Art Finishers, Inc., Bronx, N.Y.

[21] Appl. No.: 356,691

[22] Filed: Dec. 15, 1994

[51] Int. Cl.[6] ..... A47F 5/00

[52] U.S. Cl. ..... 211/133; 211/131; 211/132; 211/163; 248/174

[58] Field of Search ..... 211/163, 130, 211/131, 132, 133, 144, 149, 186; 248/174; 108/94, 165, 180

[56] References Cited

U.S. PATENT DOCUMENTS

| | | | |
|---|---|---|---|
| 4,300,691 | 11/1981 | Shemtov | 211/131 |
| 4,673,090 | 6/1987 | Crosslen | 211/131 X |
| 4,688,860 | 8/1987 | Accumanno et al. | 211/144 X |
| 4,813,553 | 3/1989 | Franklin et al. | 211/133 |
| 4,974,734 | 12/1990 | Merl | 211/133 X |
| 5,024,168 | 6/1991 | Stravitz | 108/94 |
| 5,117,989 | 6/1992 | Ross | 211/144 |
| 5,213,220 | 5/1993 | McBride | 211/132 |
| 5,286,103 | 2/1994 | Price et al. | 211/131 X |
| 5,315,936 | 5/1994 | Smith | 211/149 X |

*Primary Examiner*—Robert W. Gibson, Jr.
*Attorney, Agent, or Firm*—Kirschstein, et al.

[57] ABSTRACT

A multifaceted display stand assembly includes a central stand that assumes an upright position in its condition of use. The central stand is provided with a plurality of vertically extending channels each facing in a different direction. Each of a plurality of receptacle components is accommodated and held in a different one of the vertical channels in an assembled condition of the assembly. Each receptacle component has several shelves for supporting items to be displayed. The vertical channels are bounded by respective wall sets all of which are constituted by integral sections of a single sheet of corrugated board that are folded and connected to one another in such a manner as to form the vertical channels and also a hollow space in the center of the stand.

18 Claims, 2 Drawing Sheets

MULTIFACETED DISPLAY STAND

BACKGROUND OF THE INVENTION

1. Field of the Invention

The present invention relates to arrangements for holding goods on display in general, and more particularly to multifaceted display stands.

2. Description of the Related Art

Various constructions of display arrangements are already known, among them multifaceted display stands that are provided on more than one of their sides with shelves, bins or receptacles for the goods to be displayed. Display stands of this type are intended for use in store aisles and at similar locations where potential customers may approach the display stand from different directions or move about the stand to look at or examine the goods on display at any or all of the sides of the display stand.

In one known construction of a display stand of this kind, there is provided a hollow central post of a square cross section that, like the other components of the display stand, is made of a material that is frequently used in display stands of this type, namely corrugated board. The post, in its operative condition, is supported in an upright position on the store floor or the like. Four display receptacle structures are juxtaposed each with one of the sides of the central post, extending laterally beyond the same in a cantilevered fashion. The display receptacle structures are separate from the central post but are connected thereto by well-known means, such as by staples or the like. Each such display receptacle structure has several shelves or pockets for supporting and/or accommodating the goods to be displayed.

Experience with a display stand construction of the type described above has shown that, as advantageous as it may be in certain respects, it leaves much to be desired in others. So, for instance, the process of attaching (stapling) the display receptacle structures to the central post is rather laborious and cumbersome even if performed at a manufacturing plant, and requires a relatively high degree of skill and a more than usual degree of care on the part of the assembler, especially when performed, as it often is, at the point of use, that is, in a store or the like.

Moreover, this type of attachment is not necessarily completely reliable even if properly done, inasmuch as the forces acting on the staples as the assembled stack is being transported and/or erected, and those attributable to the influence of the weight of the items on display on the receptacle structures may cause deformation of the staples or, even more likely, tearing of the cardboard around them, with attendant loss of the connecting function of such fasteners.

OBJECTS OF THE INVENTION

Accordingly, it is a general object of the present invention to avoid the disadvantages of the prior art.

More particularly, it is an object of the present invention to provide a multifaceted display arrangement which does not possess the drawbacks of the known arrangements of this type.

Still another object of the present invention is to devise a display arrangement of the type here under consideration which is easy to assemble at the point of use.

It is yet another object of the present invention to design the above arrangement in such a manner as to reduce, if not eliminate, the possibility of its falling apart while in use.

A concomitant object of the present invention is so to construct the display arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a multifaceted display stand assembly that includes a central stand and a plurality of receptacle components. The central stand, which assumes an upright position in its condition of use, includes delimiting means for bounding a plurality of vertically extending channels each facing in a different direction. Each of the receptacle components is accommodated in one of the vertical channels in an assembled condition of the assembly and includes support means for supporting items to be displayed. There is further provided means for holding the receptacle components in the respective channels.

The assembly as described so far has the advantage that, inasmuch as the central stand includes the means for delimiting the respective channels, the assembly has a very sturdy configuration. On the other hand, the receptacle components, that are constructed as members separate from the central stand but are accommodated in the respective vertical channels of the stand and held therein by appropriate holding means, also exhibit excellent stability, at least in the assembled condition of the assembly.

According to an advantageous feature of the present invention, each of the receptacle components includes a pair of side walls and the support means of each of the receptacle components includes a multitude of shelves extending between and connected to the side walls. This, by itself, imparts a relatively high degree of stability on the respective receptacle component. However, this stability is further improved if, in accordance with another aspect of the present invention, each of the receptacle components further includes a multitude of barrier elements each connected to the side walls and to one of the shelves and extending substantially vertically with respect to the latter along an edge thereof that is remote from the central stand in the assembled condition of the assembly.

It is further advantageous when the delimiting means of the central stand includes a plurality of wall sets, each of the wall sets bounding one of the vertical channels and the wall sets collectively bounding a hollow central space in the central stand. Advantageously, each of the wall sets of the central stand includes a pair of lateral walls and a back wall extending between the lateral walls and bounding the hollow central space. Under these circumstances, it is also advantageous when each of the receptacle components has an open back, and when the back wall of each of the wall sets of the central stand constitutes a rear wall for that of the receptacle components which is accommodated in the respective vertical channel bounded by the respective wall set. Then, the holding means may advantageously include a number of staples passing through at least one of the side walls of each of the receptacle components and through one of the lateral walls of that of the wall sets that bound the respective vertical channel accommodating that particular one of said receptacle components.

According to another facet of the present invention, the holding means may include a tray-shaped base that supports the central stand from below in the upright condition of use and engages the receptacle components to keep the same in those of the vertical channels in which they are accommodated in the assembled condition of the assembly. This base may be provided with at least two elongated support elements supporting the base from below on a support surface in the assembled condition of the assembly, with these support elements extending substantially parallel to one another at a transverse spacing from each other. In addition to or instead of the base, the holding means may include a tray-shaped cap that is situated on top of the central stand in the upright condition of use and engages the receptacle components to keep the same in those of the vertical channels in which they are accommodated in the assembled condition of the assembly.

It is especially advantageous when, in accordance with this invention, the central stand is constituted by a single sheet of sheet material, e.g., corrugated board, including a multiplicity of integral portions that are folded and connected to one another in such a manner as to form all of the wall sets.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
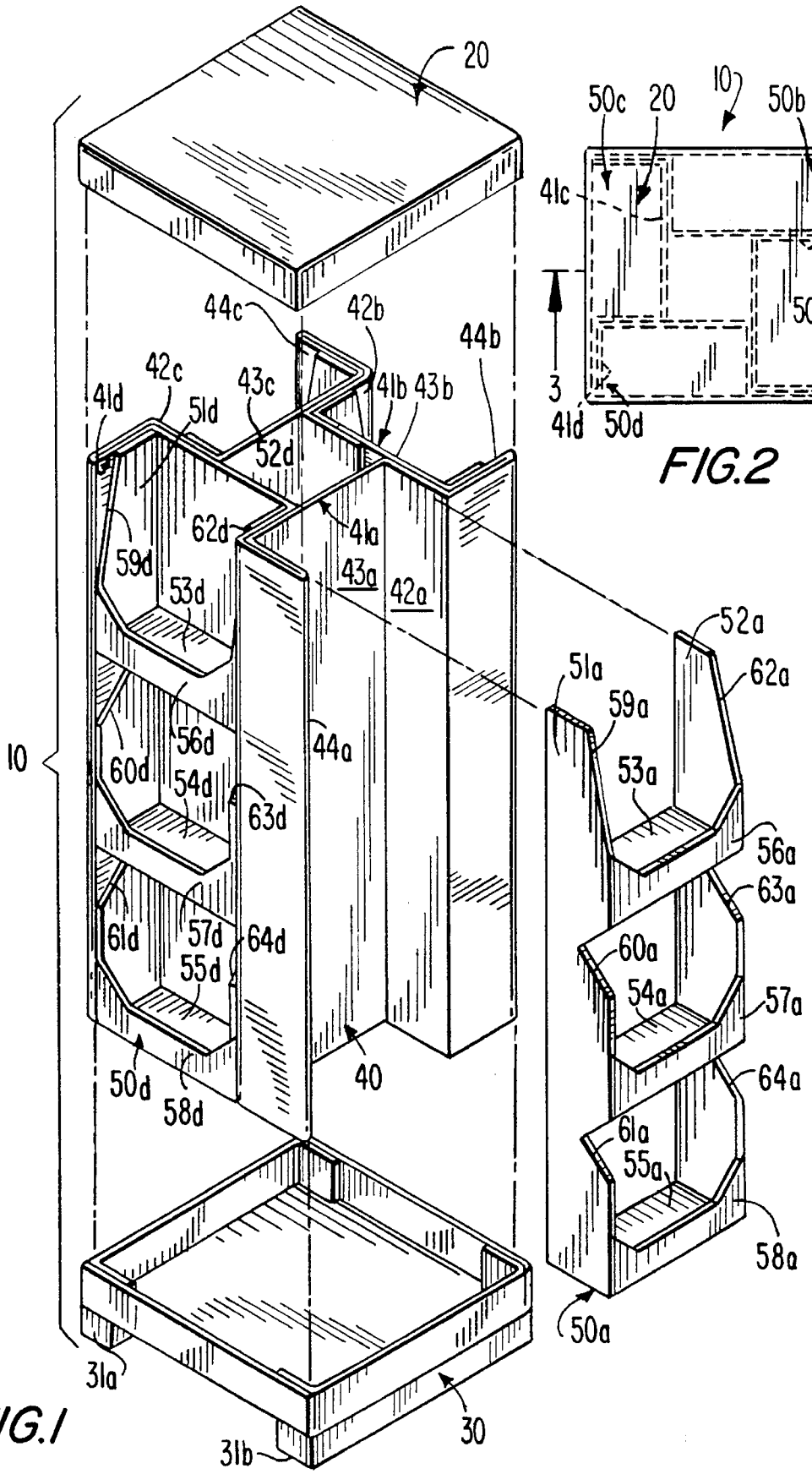
FIG. 1 is an exploded perspective view of a multifaceted display stand assembly of the present invention.

Referring now to the drawing in detail, and first to FIG. 1 thereof, it may be seen that the reference numeral 10 has been used therein to identify a multifaceted display stand assembly of the present invention in its entirety. The display stand assembly 10 includes as its main components an upper component or cap 20, a bottom component or base 30, a central component or stand 40, and a plurality of display components 50*a* to 50*n*, wherein n denotes any desired positive integral number. In the illustrated embodiment, n amounts to four, meaning that there are four display components 50*a* to 50*d*, of which only the first and the last are actually depicted in FIG. 1.

At this juncture, it is to be mentioned that, when reference is being had to directions, relative locations or orientation, they are to be understood to relate to the situation depicted in an exploded fashion in FIG. 1, that is with the cap 20 on top, with the base 30 at the bottom, with the stand 40 in between, and with the display components 50*a* to 50*d* positioned at the four sides of the stand 40. Incidentally, this very same orientation, but following the assembly of the components 20, 30, 40, and one or more (usually all) of the components 50*a* to 50*d* with one another, is that assumed by the display stand assembly 10 during its actual use for displaying selected items, objects, articles or goods in a retail establishment or the like, and is referred to herein as the operative position of the display stand assembly 10.

Figure 2:
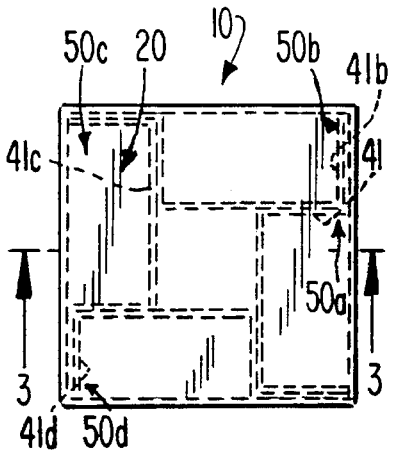
FIG. 2 is a top plan view of the assembly of FIG. 1 in its assembled condition.
Figure 3:
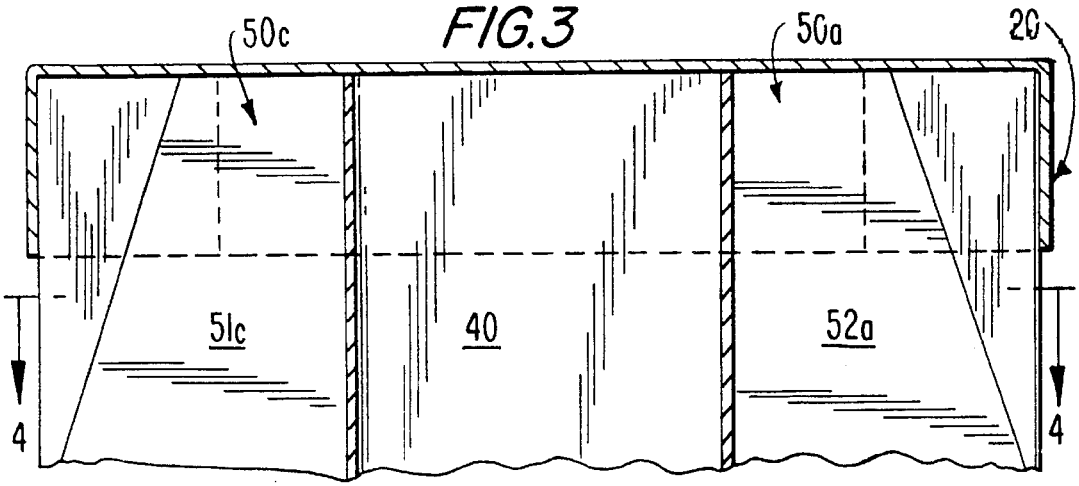
FIG. 3 is a vertical sectional view, at a somewhat enlarged scale, of an upper portion of the invention assembly taken along lines 3—3 of FIG. 2.

The cap 20 and the base 30 have substantially identical tray-shaped basic configurations and are dimensioned to receive, with only a quite small amount of leeway, the respective upper and lower ends of the stand 40, as well as those of the display components 50*a* to 50*d* when assembled with the stand 40. The stand 40 has four substantially vertical channels 41*a* to 41*d* each for receiving one of the display components 50*a* to 50*d* in the assembled condition of the display stand assembly 10. The display components 50*a* to 50*d* are so dimensioned relative to the stand 40 as to be substantially snugly received in the associated channels 41*a* to 41*d* without projecting to any meaningful extent out of them in the respective outward directions and to be substantially vertically coextensive with the respective channels 41*a* to 41*d* as considered in the operative position. This, coupled with the minimum leeway with which these components 40 and 50*a* to 50*d* are received in the tray-shaped base 30 and in the tray-shaped cap 20, assures that at least the base 30 holds the components 40 and 50*a* to 50*d* together when the display stand assembly 10 is in its operative position, as may be observed in FIG. 2 of the drawing.

It may also be seen in FIG. 1 of the drawing that each of the shown receptacle components 50*a* and 50*d* (and similarly also each of the receptacle components 50*b* and 50*c* that are not depicted there) has two side walls 51*a* and 52*a* or 51*d* and 52*d*, three shelves 53*a* to 55*a* or 53*d* to 55*d* that extend substantially horizontally between the side walls 51*a* and 52*a* or 51*d* and 52*d*, being directly connected thereto in any known manner that need not be discussed here, and three front barriers 56*a* to 58*a* or 56*d* to 58*d* that are connected to (preferably integral with) at least the respective side walls 51*a* and 52*a* or 51 d and 52*d*, but preferably also with the respective associated ones of the shelves 53*a* to 55*a* or 53*d* to 55*d*. The barriers 56*a* to 58*a* and 56*d* to 58*d* basically have two functions: to reinforce the shelves 53*a* to 55*a* and 53*d* to 55*d*, and to prevent articles on display from sliding off of the shelves 53*a* to 55*a* and 53*d* to 55*d*. The side walls 51*a* and 52*a* or 51*d* and 52*d* are provided with respective cutouts 59*a* to 64*a* or 59*d* to 64*d* that facilitate access to the goods on display on the shelves 53*a* to 55*a* and 53*d* to 55*d* when it desired to take such goods out for closer examination and/or purchase.

Figure 4:
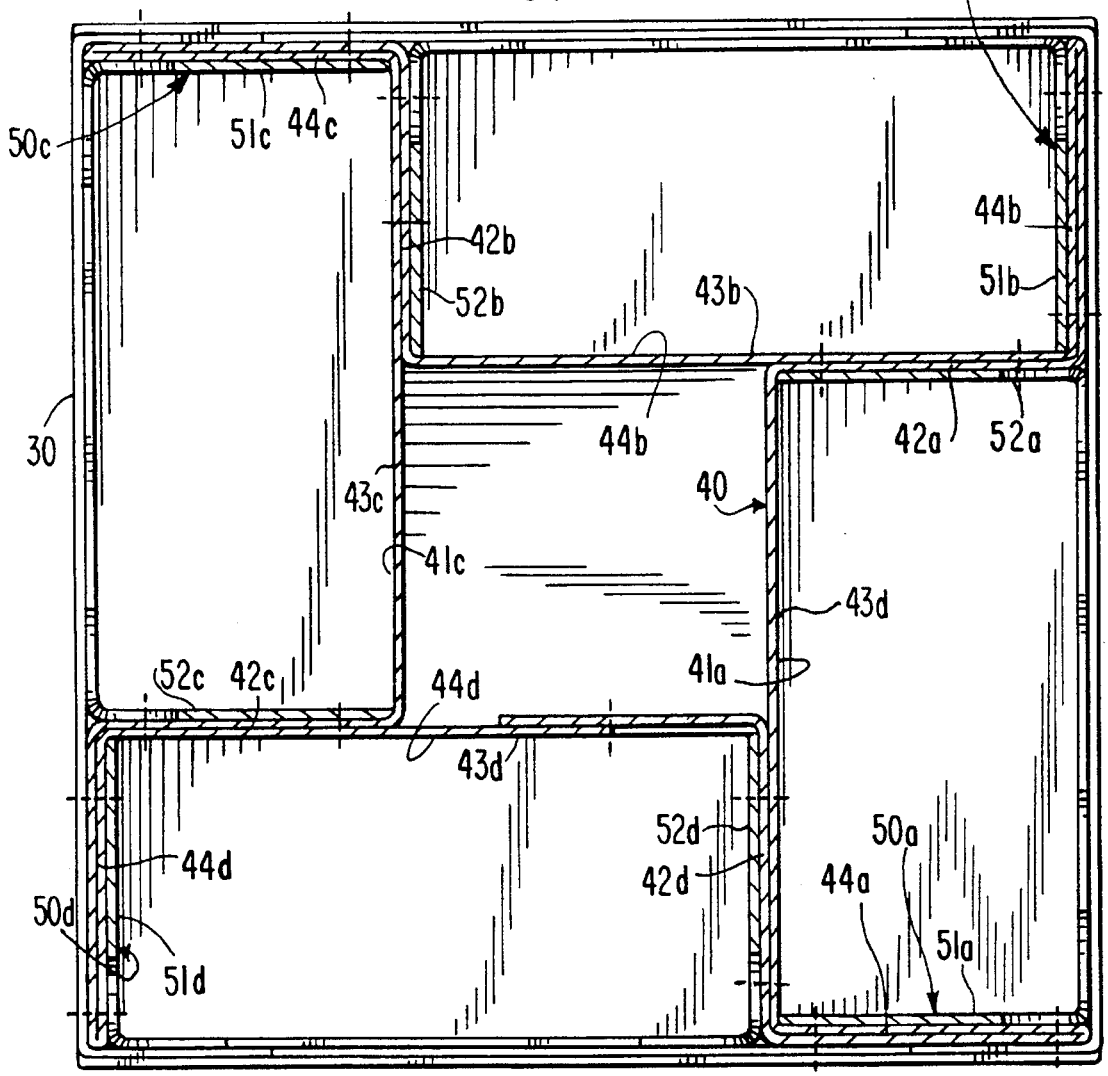
FIG. 4 is a cross-sectional view of the inventive assembly taken on line 4—4 of FIG. 3.

As consideration of FIGS. 1 and 4 in particular in conjunction with one another will reveal, the stand 40 includes a plurality of vertical walls 42*a* to 44*a*, 42*b* to 44*b*, 42*c* to 44*c*, and 42*d* to 44*d* that bound the channels 41*a*, 41*b*, 41*c* and 41*d*, respectively. Moreover, the walls 43*a*, 43*b*, 43*c* and 43*d* jointly bound a hollow central space of the stand 40. Advantageously, the walls 44*a*, 44*b*, 44*c* and 44*d* are provided on their outwardly facing surfaces with informational, advertising or decorative matter tending to attract the attention of prospective customers to the goods on display.

It can be ascertained from FIG. 4 that the walls 42*a* to 44*a*, 42*b* to 44*b*, 42*c* to 44*c*, and 42*d* to 44*d*, rather than being formed from separate pieces of corrugated board, each for instance defining one of the channels 41*a* to 41*d*, are constituted by integral portions of a single cardboard sheet that is or are appropriately folded and connected to one another, preferably by staples passing through the double walls 42*a* to 42*d* and 44*a* to 44*b*, as well as through the two juxtaposed end layers constituting the wall 43*d*.

It may also be seen that the components 50*a* to 50*d* have open backs, which means, on the one hand, that the walls 43*a* and 42*d*, 43*b* and 42*a*, 43*c* and 42*b*, and 43*d* and 42*c* double as back walls for the components 50*a*, 50*b*, 50*c* and 50*d*, respectively, and that the components 50*a*, 50*b*, 50*c* and 50*d* cannot be attached to the stand 40 by driving staples through the nonexistent back walls. On the other hand, there is nothing that would prevent the use of staples for connecting the side walls 52*a* to 52*d* of the components 50*a* to 50*d* to the walls 42*a* to 42*d* of the stand 40, or of the side walls 51*a* to 51*d* to the walls 44*a* to 44*d*, in that order, or both. As a matter of fact, such a stapling operation is relatively easy to perform, can be automated, and brings about the advantage that the stressing of the staples is mostly in shear which the areas of the cardboard through which the staples pass, can easily withstand without being damaged.

The display stand assembly 10 can be produced in any desired size, but it is currently contemplated to make it about as tall as an average person. Especially for this application, it is proposed to provide the tray-shaped base 30 on its downwardly facing major surface with a pair of attached corrugated board ribs or wooden laths 31*a* and 31*b* which keep the tray-shaped base spaced from the ground or other horizontal surface on which the laths 31*a* and 31*b* rest. This spacing, for one, avoids wetting or moistening of the base 30 as the floor around the assembly 10 is being washed, with attendant weakening or deterioration of its corrugated board material. On the other hand, and possibly more importantly, this spacing renders it possible to introduce the prongs of a forklift truck under the base 30, thus making it possible to lift, move and otherwise manipulate the assembly 10 without having to remove the goods on display thereon first.

It will be understood that each of the elements described above, or two or more together, may also find a useful application in other types of constructions differing from the type described above.

While the present invention has been described and illustrated herein as embodied in a specific construction of a multifaceted display stand assembly including a plurality of receptacle components accommodated in vertical channels of a central stand, it is not intended to be limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A multifaceted display stand assembly comprising:

a) a central stand assuming an upright position in its condition of use and including delimiting means for bounding a plurality of vertically extending channels each facing in a different direction;

b) a plurality of receptacle components each accommodated in one of said vertical channels in an assembled condition of said assembly, and each of said receptacle components having a pair of side walls and including support means for supporting items to be displayed, said support means of each of said receptacle components having a multitude of shelves extending between and connected to said side walls, each of said receptacle components further having a multitude of barrier elements each connected to said side walls and to one of said shelves and extending substantially vertically with respect to the latter along an edge thereof that is remote from said central stand in said assembled condition of the assembly; and c) means for holding said receptacle components in said channels.

2. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space;

b) a plurality of receptacle components each accommodated in one of said vertical channels in an assembled condition of said assembly, each of said receptacle components having an open back, and said back wall of each of said wall sets of said central stand constituting a rear wall for that of said receptacle components that is accommodated in the respective vertical channel bounded by said wall set, and including support means for supporting items to be displayed; and c) means for holding said receptacle components in said channels.

3. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space;

b) a plurality of receptacle components each accommodated in one of said vertical channels in an assembled condition of said assembly and including support means for supporting items to be displayed; and c) means for holding said receptacle components in said channels, said holding means including a number of staples passing through at least one of said side walls of each of said receptacle components and through one of said lateral walls of that of said wall sets that bounds the respective vertical channel accommodating that particular one of said receptacle components.

4. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space;

b) a plurality of receptacle components each accommodated in one of said vertical channels in an assembled condition of said assembly and including support means for supporting items to be displayed; and c) means for holding said receptacle components in said channels, said holding means including a tray-shaped base that supports said central stand from below in said upright condition of use and engages said receptacle components to keep the same in those of said vertical channels in which they are accommodated in said assembled condition of the assembly, said tray-shaped base including at least two elongated support elements supporting said base from below on a support surface in said assembled condition of the assembly, said support elements extending substantially parallel to one another at a transverse spacing from each other.

5. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space;

b) a plurality of receptacle components each accommodated in one of said vertical channels in an assembled condition of said assembly and including support means for supporting items to be displayed; and c) means for holding said receptacle components in said channels, said holding means including a tray-shaped cap that is situated on top of said central stand in said upright condition of use and engages said receptacle components to keep the same in those of said vertical channels in which they are accommodated in said assembled condition of the assembly.

6. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space, said central stand being constituted by a single sheet of sheet material including a multiplicity of integral portions that are folded and connected to one another in such a manner as to form all of said wall sets;

b) a plurality of receptacle components each accommodated in one of said vertical channels in an assembled condition of said assembly and including support means for supporting items to be displayed; and c) means for holding said receptacle components in said channels.

7. A multifaceted display stand assembly comprising:

a) a central stand assuming an upright position in its condition of use and including delimiting means for bounding a plurality of vertically extending channels each facing in a different direction, said delimiting means of said central stand including a plurality of wall sets, each of said wall sets bounding one of said vertical channels and said wall sets collectively bounding a hollow central space in said central stand, each of said wall sets of said central stand including a pair of lateral walls and a back wall extending between said lateral walls and bounding said hollow central space, said central stand including a nultiplicity of integral portions that are folded and connected to one another in such a manner as to form all of said wall sets:

b) a plurality of receptacle components each accommodated in one of said vertical channels in an assembled condition of said assembly and including support means for supporting items to be displayed; and c) means for holding said receptacle components in said channels.

8. The multifaceted display stand assembly as defined in claim 7, wherein each of said receptacle components includes a pair of side walls; and wherein said support means of each of said receptacle components includes a multitude of shelves extending between and connected to said side walls.

9. The multifaceted display stand assembly as defined in claim 8, wherein each of said receptacle components further includes a multitude of barrier elements each connected to said side walls and to one of said shelves and extending substantially vertically with respect to the latter along an edge thereof that is remote from said central stand in said assembled condition of the assembly.

10. The multifaceted display stand assembly as defined in claim 7, wherein said delimiting means of said central stand includes a plurality of wall sets, each of said wall sets bounding one of said vertical channels and said wall sets collectively bounding a hollow central space in said central stand.

11. The multifaceted display stand assembly as defined in claim 10, wherein each of said wall sets of said central stand includes a pair of lateral walls and a back wall extending between said lateral walls and bounding said hollow central space.

12. The multifaceted display stand assembly as defined in claim 11, wherein each of said receptacle components has an open back; and wherein said back wall of each of said wall sets of said central stand constitutes a rear wall for that of said receptacle components that is accommodated in the respective vertical channel bounded by said wall set.

13. The multifaceted display stand assembly as defined in claim 10, wherein said holding means includes a number of staples passing through at least one of said side walls of each of said receptacle components and through one of said lateral walls of that of said wall sets that bounds the respective vertical channel accommodating that particular one of said receptacle components.

14. The multifaceted display stand assembly as defined in claim 11, wherein said holding means includes a tray-shaped base that supports said central stand from below in said upright condition of use and engages said receptacle components to keep the same in those of said vertical channels hi which they are accommodated in said assembled condition of the assembly.

15. The multifaceted display stand assembly as defined in claim 14, wherein said tray-shaped base includes at least two elongated support elements supporting said base from below on a support surface in said assembled condition of the assembly, said support elements extending substantially parallel to one another at a transverse spacing from each other.

16. The multifaceted display stand assembly as defined in claim 11, wherein said holding means includes a tray-shaped cap that is situated on top of said central stand in said upright condition of use and engages said receptacle components to keep the same in those of said vertical channels in which they are accommodated in said assembled condition of the assembly.

17. The multifaceted display stand assembly as defined in claim 11, wherein said central stand is constituted by a single sheet of sheet material including a multiplicity of integral portions that are folded and connected to one another in such a manner as to form all of said wall sets.

18. The multifaceted display stand assembly as defined in claim 6, wherein the sheet material is corrugated board.

* * * * *